United States Patent [19]

Selvia et al.

[11] 3,986,642

[45] Oct. 19, 1976

[54] ADJUSTABLE NOZZLE ASSEMBLY FOR DISPENSING LIQUID

[75] Inventors: Ray E. Selvia; Allan D. Barden, both of Terre Haute, Ind.

[73] Assignee: All State Vending Equipment, Inc., Terre Haute, Ind.

[22] Filed: Oct. 2, 1974

[21] Appl. No.: 511,287

[52] U.S. Cl. ..... 222/129.1; 239/420; 248/75; 403/90

[51] Int. Cl.[2] ..... B67D 5/56

[58] Field of Search ..... 222/330, 129.1–129.4, 222/536; 239/420, 422, 428, 436, 306; 248/75–88; 269/243, 268–270; 403/90, 142, 143

[56] References Cited

UNITED STATES PATENTS

| | | | |
|---|---|---|---|
| 908,776 | 1/1909 | Kittle et al. | 239/422 X |
| 1,726,315 | 8/1929 | Rose | 222/536 |
| 2,933,125 | 4/1960 | Anderson | 239/422 X |

FOREIGN PATENTS OR APPLICATIONS

| | | | |
|---|---|---|---|
| 561,019 | 10/1957 | Belgium | 239/306 |

*Primary Examiner*—Robert B. Reeves
*Assistant Examiner*—Francis J. Bartuska
*Attorney, Agent, or Firm*—Woodard, Weikart, Emhardt & Naughton

[57] ABSTRACT

A nozzle assembly for dispensing liquid which is adjustable to direct the streams of liquid at various angles. Multiple aligned clamp blocks are secured to a mounting bracket. Adjacent clamp blocks have mutually facing surfaces with pairs of recesses formed therein to pivotally receive a plurality of nozzles. The nozzles each include a tubular member having a spherical portion received in the recesses. The tubes are connected to sources of liquid. The number of nozzles in the assembly may be increased by linear extension as well as by adding additional rows to increase the depth of the assembly. A threaded member secures the clamp blocks to the bracket with the clamp blocks being pivotable and the nozzles being pivotable until the threaded member is tightened. A fastener secures the bracket to a bulkhead with the bracket being pivotable until the fastener is tightened. The clamp blocks have tapered cross sections to allow pivoting of the nozzles.

12 Claims, 6 Drawing Figures

ADJUSTABLE NOZZLE ASSEMBLY FOR DISPENSING LIQUID

BACKGROUND OF THE INVENTION

1. Field of the Invention

This invention is in the field of liquid dispensers and more specifically relates to nozzles.

2. Description of the Prior Art

A number of different designs of nozzles have been provided for the dispensing of various liquids. For example, in the vending industry for dispensing carbonated drinks, a nozzle is used for dispensing various types of different carbonated drinks. In many cases, the nozzles are fixedly mounted within the dispensing cabinet preventing adjustment of the nozzle for the proper aiming of the stream of liquid. Carbonated water will loose its high level of carbonization unless the carbonated water stream is directed into the receptacle at a proper angle and mixed with the liquid drink concentrate in an efficient manner. Disclosed herein is an assembly which inlcudes a plurality of nozzles which may be readily adjusted so as to direct the stream of liquid dispensed from each nozzle. The nozzle assembly disclosed herein is particularly advantageous in that a number of nozzles in the assembly may be increased by linear extension along a single row. In addition, additional rows of nozzles may be added to the assembly. The clamps securing the nozzles in place are designed to allow for the maximum pivotal movement of each nozzle as compared to the prior art devices which restrict the amount of motion of a nozzle.

SUMMARY OF THE INVENTION

One embodiment of the present invention is a liquid dispensing nozzle assembly comprising a wall, first and second spaced apart clamp blocks having pairs of mutually facing recesses, mounting means extending through the blocks and fastening the blocks to the wall and operable to vary the distance between recesses of one of the blocks relative to the recesses of an adjacent block, and a plurality of nozzles mounted between the blocks, each nozzle having a hollow tube connectable to a source of liquid and a round portion on the tube being received by a pair of mutually facing recesses allowing pivoting of the nozzle to aim a liquid stream discharged by the nozzle.

It is an object of the present invention to provide a new and improved nozzle assembly.

A further object of the present invention is to provide a nozzle assembly wherein the number of nozzles in the assembly may be increased by linear extension in each row as well as by adding additional rows to the assembly.

Yet another object of the present invention is to provide a nozzle assembly wherein the nozzles may be easily adjusted to direct the stream of liquid at the desired angle with respect to the receptacle receiving the liquid as well as relative to an additional stream of liquid simultaneously dispensed into the receptacle by another nozzle.

Also it is an object of the present invention to provide a nozzle assembly which is readily expandable for additional nozzles.

Likewise, it is an object of the present invention to provide a nozzle assembly which allows for easy disassembly and reassembly for sanitation purposes.

In conjunction with the above objects, it is an object of the present invention to provide a nozzle assembly wherein broken components including broken nozzles or retainers may be easily replaced.

Another object of the present invention is to provide a nozzle assembly wherein the nozzles can be positioned and then locked in place by a fastener.

Related objects and advantages of the present invention will be apparent from the following description.

DESCRIPTION OF THE PREFERRED EMBODIMENTS

Figure 1:
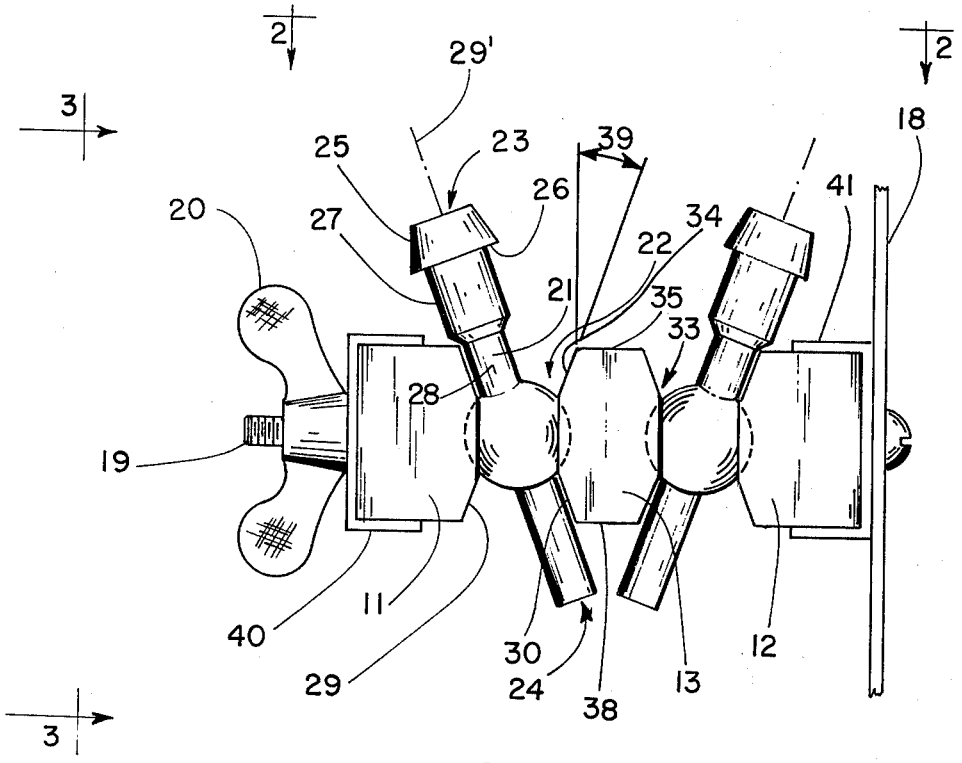
FIG. 1 is a side view of a nozzle assembly incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the inventions as illustrated therein being contemplated as would normally occur to one skilled in the art to which the invention relates.

Figure 2:
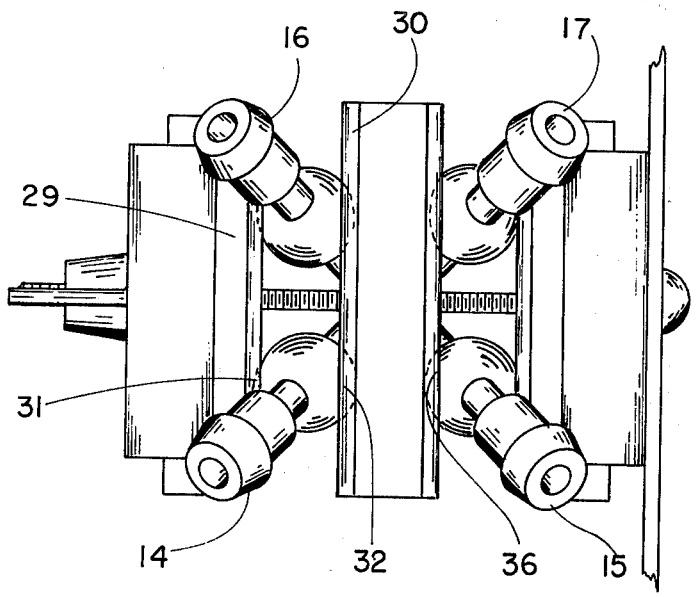
FIG. 2 is a top view of the nozzle assembly looking in the direction of arrows 2—2 of FIG. 1.
Figure 3:
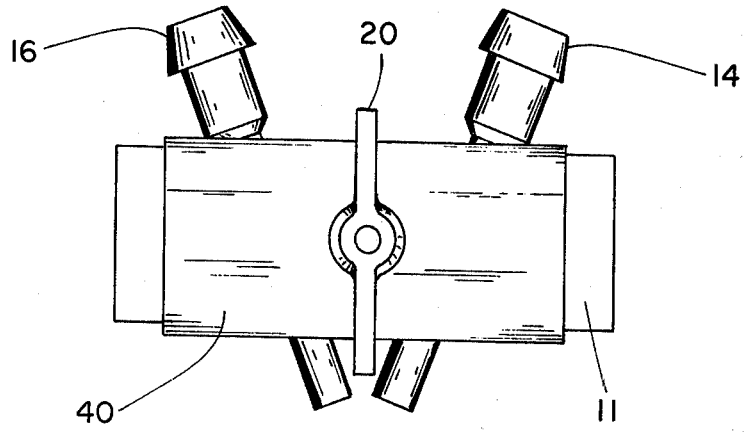
FIG. 3 is an end view of the nozzle assembly looking in the direction of arrows 3—3 of FIG. 1.

Referring now more particularly to FIGS. 1 through 3, there is shown a nozzle assembly including a pair of end clamp blocks 11 and 12 with a third clamp block 13 disposed therebetween. Four nozzles 14 through 17 are pivotally mounted between the clamp blocks which are secured to wall 18 by a threaded fastener 19 and a conventional wing nut 20.

Nozzle 14 will now be described it being understood that a similar description applies to nozzles 15 through 17. Nozzle 14 includes a hollow tubular member 21 having formed thereon a spherical portion 22. Tube 21 has an inlet 23 and an outlet 24. The top end of tube 21 is enlarged having a generally truncated conical portion 25 for receiving a tube connected to a source of liquid. Portion 25 is provided with a shoulder 26 as well as a circular portion 27 of a diameter larger than the diameter of tube 21 at location 28. The longitudinal axis 29' extends centrally through tube 21.

The clamp blocks are retainers for securing the spherical portion of each nozzle. For example, clamp blocks 11 and 13 are provided with mutually facing surfaces 29 and 30 with pairs of recesses to receive the spherical portions. Surface 29 includes recess 31 positioned directly opposite recess 32 provided in surface 30. Recesses 31 and 32 are formed by a radius equal to the radius of spherical portion 22. As a result, the recesses complementarily receive spherical portion 22, with each recess extending approximately twenty percent around the circumference of the spherical portion. By tightening wing nut 20, the distance between the recesses in blocks 11 and 13 may be decreased forcing the clamp blocks to tightly grip the nozzles locking the angular position of each nozzle.

Clamp block 13 has a side surface 33 facing clamp block 12 and a second side surface 34 facing clamp block 11. Surfaces 33 and 34 diverge from the top edge 35 of clamp block 13 toward recesses 32 and 36 and then converge from recesses 32 and 36 to the bottom edge 38 of the clamp block. Thus, a relief is formed above and below the recesses in clamp block 13 to allow the nozzles to be pivoted. In one embodiment, each surface 33 and 34 formed an angle 39 with respect to vertical of 21 degrees. The surfaces of clamp blocks 11 and 12 facing clamp block 13 are likewise provided with reliefs above and below the recesses in clamp blocks 11 and 12 to allow for the pivoting of the nozzles.

In one embodiment, each recess receiving a spherical portion of a nozzle was defined by a one-quarter inch spherical radius with the spherical portion of each nozzle having a diameter of one-half inch. In the same embodiment, the nozzles and clamp blocks or retainers were produced from plastic. A pair of clamp brackets produced from metal conformingly fit onto blocks 11 and 12. Clamp bracket 40 fits into block 11 whereas clamp bracket 41 fits onto block 12. Threaded member 19 which is a screw extends through brackets 40 and 41 as well as the three clamp blocks and bulkhead 18. The head of threaded member 19 is positioned adjacent bulkhead 18 with wing nut 20 being threadedly received on the threaded member forcing the clamp blocks to tightly grip the nozzles when positioned at the desired angle.

Figure 5:
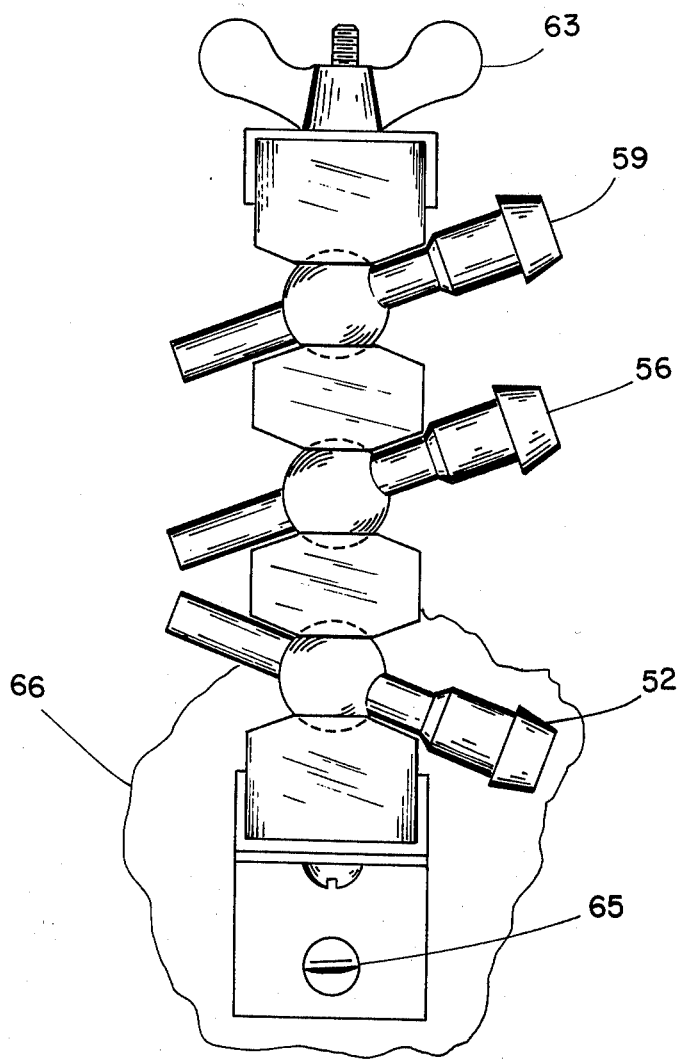
FIG. 5 is a side view of the alternate nozzle assembly looking in the direction of arrows 5—5 of FIG. 4.
Figure 4:
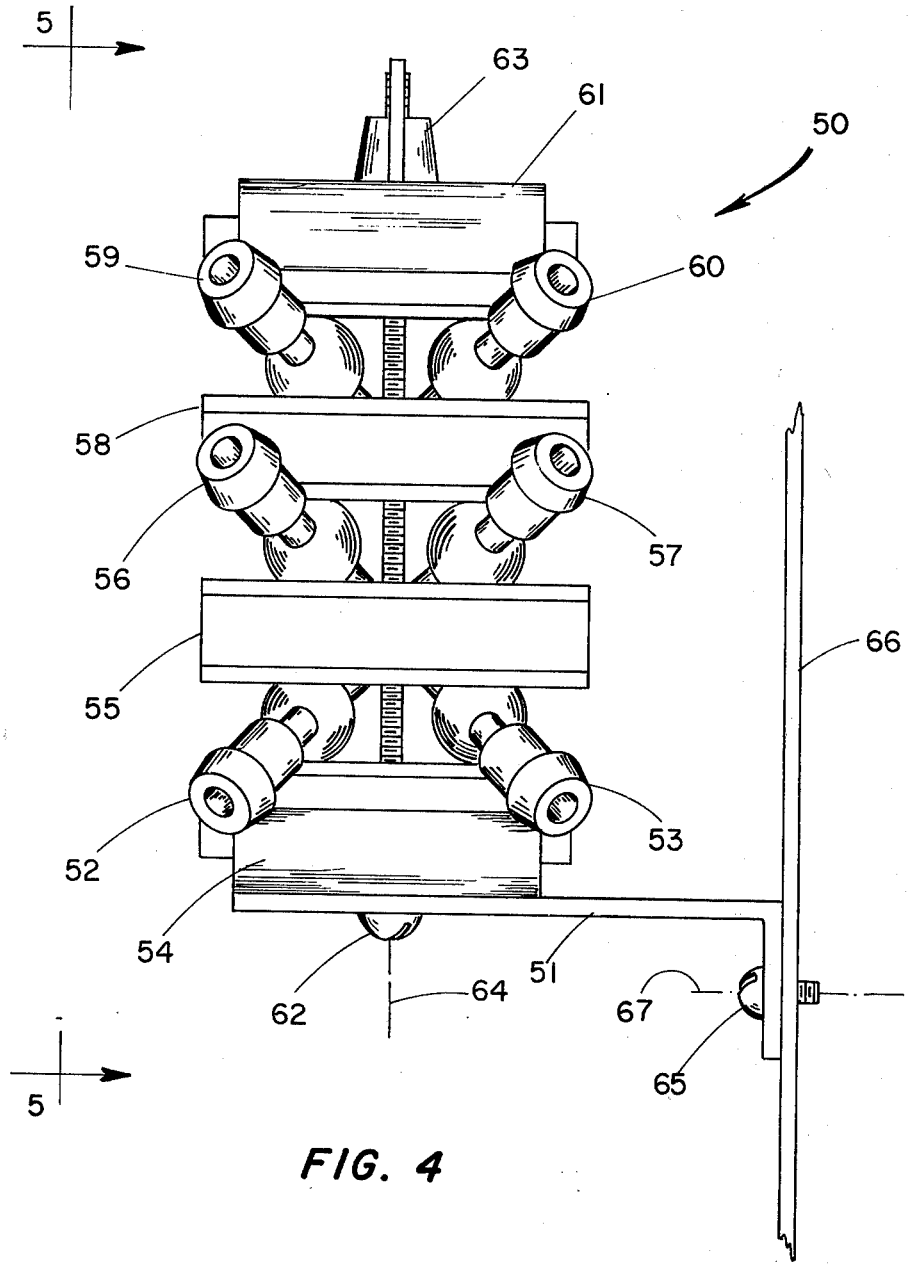
FIG. 4 is a top view of an alternate embodiment of the nozzle assembly incorporating the present invention.

An alternate embodiment of the nozzle assembly is shown in FIGS. 4 and 5. Nozzle assembly 50 is identical to the nozzle assembly shown in FIG. 1 with the exception that the assembly is mounted on a right angle bracket 51 and in addition has a third row of nozzles instead of only two rows of nozzles. Nozzles 52 and 53 have spherical portions received in spherical recesses in clamp blocks 54 and 55 with nozzles 56 and 57 also having spherical portions received in spherical recesses provided in clamp blocks 55 and 58. In addition, nozzles 59 and 60 have spherical portions pivotally received in spherical recesses provided in clamp blocks 58 and 61. Threaded member 62 extends through the clamp blocks and is threadedly received by wing nut 63. All of the clamp blocks and nozzles may be pivoted prior to the tightening of wing nut 63 about a central axis 64 extending through fastener 62. Fastener 65 secures right angle bracket 51 to bulkhead 66. As a result, the entire nozzle assembly may be pivoted about axis 67 prior to the tightening of fastener 65. Axis 67 extends perpendicular to axis 64 allowing the entire nozzle assembly to be positioned at the desired angle.

Figure 6:
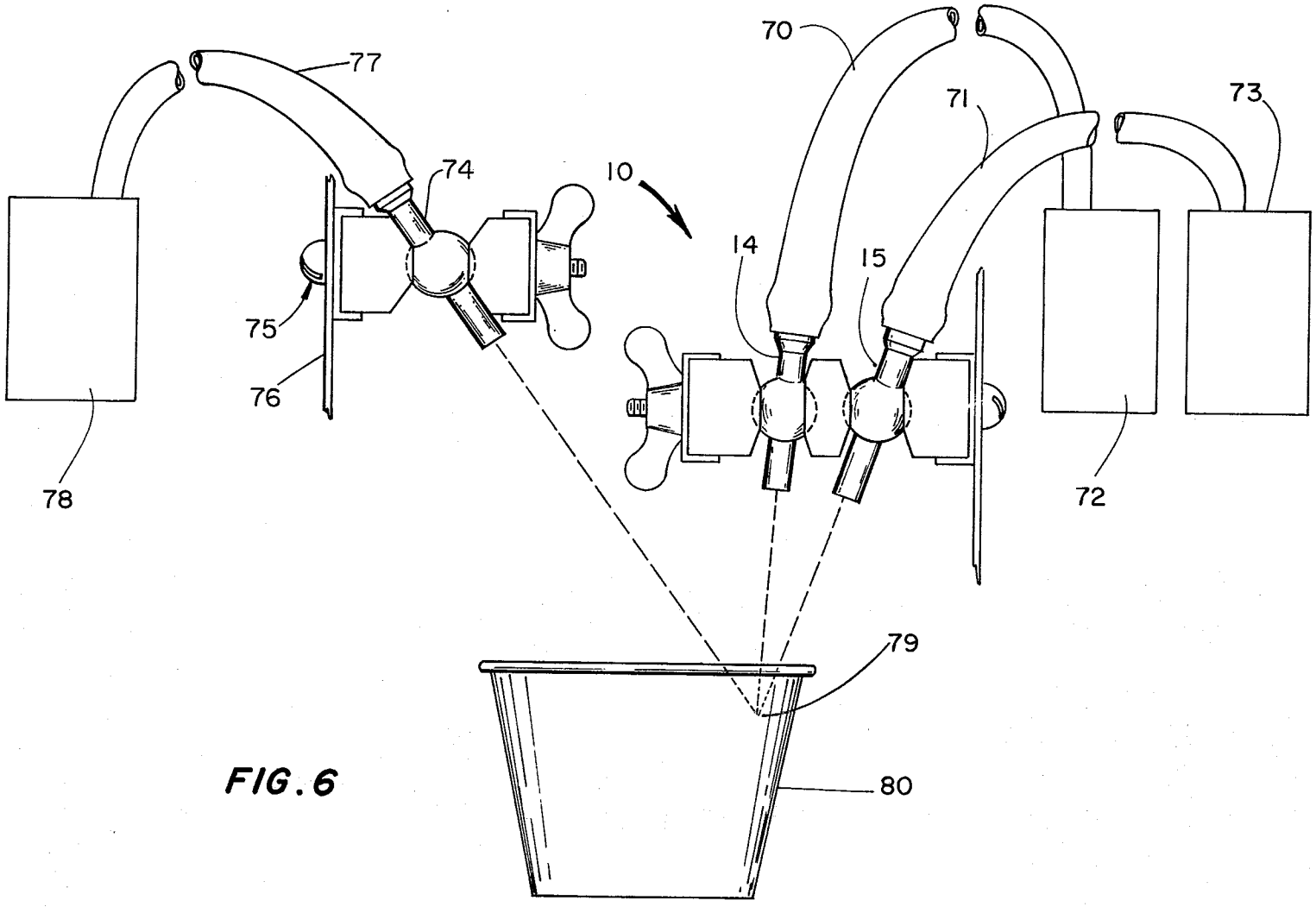
FIG. 6 is a side view of the alternate nozzle assembly of FIG. 1 mounted within a dispensing cabinet and a carbonated water dispensing nozzle wherein liquid drink concentrate and carbonated water are respectively directed into a receptacle.

Nozzle assembly 10 shown in FIG. 6 is identical to the nozzle assembly shown in FIG. 1 and has nozzles 14 and 15 connected by conduits 70 and 71 to sources 72 and 73 of liquid drink concentrate. An additional nozzle 74 mounted by clamp 75 to wall 76 is connected by conduit 77 to a source 78 of carbonated water. Nozzles 14, 15 and 74 are aimed to intersect at location 79 within receptacle 80. The nozzles along with the necessary pumps and electrical circuitry are mounted within a dispensing cabinet which allows the operator to dispense carbonated water from nozzle 74 and liquid drink concentrate from either nozzle 14 or 15 into receptacle 80 to obtain a mixed carbonated drink. Nozzle assembly 10 is unique since the nozzles of the nozzle assembly may be readily positioned so that the syrup streams dispensed by the nozzles of nozzle assembly 10 intersect the stream of carbonated water from nozzle 74. Once the nozzles are in position, the nozzles may be secured in place by tightening the fasteners, securing the clamp blocks and nozzles within the dispensing cabinet.

It will be obvious from the above description that the present invention provides a nozzle assembly wherein the number of nozzles in the assembly may be increased by linear extension in a single row as well as by adding additional rows to the assembly. For example, the nozzle assembly shown in FIG. 4 has three rows of nozzles whereas the nozzle assembly shown in FIG. 1 has only two rows of nozzles. Additional rows of nozzles may be added as required. It will be further obvious from the above description that the present invention provides a nozzle system which may be easily adjusted to aim the nozzles at the desired angle. The fasteners used to secure the clamp blocks and nozzles together may be readily untightened so as to allow for easy disassembly and reassembly for sanitation and for easy replacement of broken nozzles or clamp blocks.

Many variations are contemplated and included in the present invention. For example, the nozzle assembly may be mounted on a swivel bracket to further inhance the directional adjustment. Likewise, a variety of means may be utilized to secure the nozzle retainers. For example, the direction of the fastener 19 (FIG. 1) may be reversed and changed to a thumbscrew with a nut welded behind and to the bulkhead. Each nozzle may be offset from vertical 21° in any direction. The complete unit can then be rotated around a locking screw in a complete circle.

The tube of each nozzle is provided with a passage extending centrally therethrough to facilitate the flow of syrup. The size of the passage may be varied over a wide range depending upon the syrup dispensed by the nozzle. Additional variations in the design are contemplated and included in the present invention.

While the invention has been illustrated and described in detail in the drawings and foregoing description the same is to be considered as illustrative and not restrictive in character, it being understood that only the preferred embodiments have been shown and described and that all changes and modifications that come within the spirit of the invention are desired to be protected.

The invention claimed is:

1. A liquid dispensing nozzle assembly comprising:

a wall;

first and second spaced apart clamp blocks having pairs of mutually facing rounded recesses;

mounting means extending through said blocks at a location other than through said recesses and fastening said blocks to said wall being operable to vary the distance between recesses of one of said blocks relative to the recesses of an adjacent block to adjust the holding force exerted by said recesses; and, a plurality of nozzles mounted between said blocks, each nozzle having a hollow tube and an enlarged rounded portion on said tube, said tube having a first end connectable to a source of liquid and extending beyond the surface of said enlarged portion and a second end for discharging a liquid and extending beyond the surface of said enlarged portion, said enlarged rounded portion being complementarily received by a pair of mutually facing rounded recesses providing bearing surfaces for said enlarged portion and allowing pivoting of said nozzle about at least three perpendicularly arranged axes intersecting at said enlarged rounded portion to aim a liquid stream discharged by said nozzle;

each clamp block has a top edge and a bottom edge with said recesses positioned therebetween, said first clamp block and said second clamp block have mutually facing surfaces diverging from said recesses to said top edge and also diverging from said recesses to said bottom edge forming reliefs to allow pivoting of said tube.

2. The nozzle of claim 1 wherein:

said nozzles have longitudinal axes, said tubes have outlets and are pivotable to a position whereat said longitudinal axes intersect beneath said outlets.

3. The nozzle assembly of claim 1 and further comprising:

a third clamp block mounted to said second clamp block with said second and third clamp block having mutually facing recesses pivotally receiving some of said enlarged portions of said nozzles

4. The nozzle assembly of claim 3 wherein:

said mounting means includes a threaded member with a central axis, said member is mounted through said wall and extends through said first, second and third clamp block, said first, second and third clamp blocks may be pivoted around said central axis of said threaded member.

5. A liquid dispensing nozzle assembly comprising:

a wall;

first and second spaced apart clamp blocks having pairs of mutually facing recesses;

mounting means extending through said blocks and fastening said blocks to said wall and operable to vary the distance between recesses of one of said blocks relative to the recesses of an adjacent block;

a plurality of nozzles mounted between said blocks, each nozzle having a hollow tube connectable to a source of liquid and a round portion on said tube being received by a pair of mutually facing recesses allowing pivoting of said nozzle to aim a liquid stream discharged by said nozzle; and, a third clamp block mounted to said second clamp block with said second and third clamp block having mutually facing recesses pivotally receiving some of said round portions of said nozzles; and wherein:

said mounting means includes a threaded member with a central axis, said member is mounted through said wall and extends through said first, second and third clamp block, said first, second and third clamp blocks may be pivoted around said central axis of said threaded member;

each clamp block has a top edge and a bottom edge with said recesses positioned therebetween, said second clamp block has a first side surface facing said first clamp block and a second side surface facing said third clamp block, said first side surface and said second side surface diverge from said top edge to said recesses and converge from said recesses to said bottom edge forming reliefs to allow pivoting of said tubes.

6. The nozzle assembly of claim 5 wherein:

said wall forms a right angle bracket which is mountable to a bulkhead and further comprising a fastener mounting said bracket to said bulkhead, said bracket being rotatable around said fastener in a direction perpendicular to said central axis.

7. The nozzle assembly of claim 5 and further comprising:

a fourth clamp block mounted to said third clamp block with said third and fourth clamp block having mutually facing recesses pivotally receiving some of said rounded portions of said nozzles.

8. A liquid dispensing nozzle assembly comprising:

a wall;

first and second spaced apart clamp blocks having mutually facing recesses;

mounting means fastening said first and second clamp blocks to said wall and operable to vary the distance between recesses;

at least one nozzle mounted between said first and second clamp blocks, said nozzle having a hollow tube connectable to a source of liquid and a round portion on said tube being received by said mutually facing recesses allowing pivoting of said nozzle to aim a liquid stream discharged by said nozzle;

a third clamp block mounted to said second clamp block with said second and third clamp blocks having mutually facing recesses;

at least one nozzle mounted between said second and third clamp blocks, said nozzle having a hollow tube connectable to a source of liquid and a round portion of said tube being received by said mutually facing recesses allowing pivoting of said nozzle to aim a liquid stream discharged by said nozzle; and wherein:

each clamp block has a top edge and a bottom edge with said recesses positioned therebetween, said second clamp block has a first side surface facing said first clamp block and a second side surface facing said third clamp block, said first side surface and said second side surface diverge from said top edge to said recesses and converge from said recesses to said bottom edge forming reliefs to allow pivoting of said tubes.

9. The nozzle assembly of claim 8 wherein:

said first clamp block has a second side surface facing said first side surface of said second clamp block, said second side surface of said first clamp block and said first side surface of said second clamp block diverging from said recesses to said top edges and also diverging from said recesses to said bottom edges; and, said third clamp block has a first side surface facing said second side of said second clamp block, said first side surface of said third clamp block and said second side surface of said second clamp block diverging from said recesses to said top edges and also diverging from said recesses to said bottom edges.

10. The nozzle assembly of claim 8 and further comprising:

a fourth clamp block mounted to said third clamp block with said third and fourth clamp blocks having mutually facing recesses pivotally receiving some of said round portion of at least one of said nozzles.

11. A liquid dispensing nozzle assembly comprising:

a wall;

first and second spaced apart clamp blocks having at least one pair of mutually facing recesses;

at least one nozzle mounted between said first and second clamp blocks, said nozzle having a hollow tube and an enlarged spherical portion on said tube, said tube having a first end connectable to a source of liquid and extending beyond the surface of said enlarged portion and a second end for discharging a liquid and extending beyond the surface of said enlarge portion, said enlarged portion being complementarily received by a pair of mutually facing recesses providing bearing surfaces for said enlarged portion and allowing pivoting of said nozzle about at least three perpendicularly arranged axes intersecting at said enlarged spherical portion to aim a liquid stream discharged by said nozzle;

mounting means fastening said first and second clamp blocks to said wall and operable to vary the distance between recesses and to grip said rounded portion therebetween locking said nozzle in position;

each clamp block has a top edge and a bottom edge with said recesses positioned therebetween, said first clamp block and said second clamp block have mutually facing surfaces diverging from said recesses to said top edge and also diverging from said recesses to said bottom edge forming reliefs to allow pivoting of said tube.

12. The liquid dispensing nozzle assembly of claim 11 wherein:

said enlarged portion is spherical and said tube passes through about the center of said enlarged portion;

said recesses each extend less than fifty percent around the circumference of said enlarged portion.

* * * * *